US009511837B1

(12) United States Patent
Reeves

(10) Patent No.: US 9,511,837 B1
(45) Date of Patent: Dec. 6, 2016

(54) DEVICE FOR PROPELLING A VESSEL

(71) Applicant: John Reeves, Byfield, MA (US)

(72) Inventor: John Reeves, Byfield, MA (US)

( * ) Notice: Subject to any disclaimer, the term of this patent is extended or adjusted under 35 U.S.C. 154(b) by 10 days.

(21) Appl. No.: 14/690,618

(22) Filed: Apr. 20, 2015

(51) Int. Cl.
*B63H 16/04* (2006.01)
*B63H 1/32* (2006.01)

(52) U.S. Cl.
CPC ..... *B63H 16/04* (2013.01); *B63H 1/32* (2013.01); *B63H 2016/043* (2013.01)

(58) Field of Classification Search
CPC ..... B63H 16/00; B63H 2016/046; B63H 1/36; B36H 1/32
USPC ..... 440/101, 102, 103; 416/74
See application file for complete search history.

(56) References Cited

U.S. PATENT DOCUMENTS

| | | | | |
|---|---|---|---|---|
| 427,842 A | | 5/1890 | Dice et al. | |
| 791,852 A | * | 6/1905 | Worcester | B63H 1/36 416/82 |
| 1,066,662 A | | 7/1913 | Schmidt, Jr. | |
| 1,555,097 A | | 9/1925 | Beebe | |
| 1,805,749 A | | 5/1931 | Zoglauer | |
| 2,347,475 A | * | 4/1944 | Ford | B63H 16/04 416/71 |
| 3,135,977 A | * | 6/1964 | Vidal | B63H 16/04 416/74 |
| 4,622,017 A | | 11/1986 | McGraw | |
| 7,309,364 B1 | | 12/2007 | Wagenknecht et al. | |
| 7,922,549 B1 | * | 4/2011 | Sirota | B63H 16/04 440/20 |

FOREIGN PATENT DOCUMENTS

| | | |
|---|---|---|
| CA | 262860 | 7/1926 |

* cited by examiner

*Primary Examiner* — Andrew Polay
(74) *Attorney, Agent, or Firm* — Salter & Michaelson

(57) ABSTRACT

A device for propelling a vessel through water that includes an elongated handle; a grip at one end of the elongated handle; a paddle-shaped frame at an opposite end of the handle; a pair of blades that are pivotally supported at opposed respective sides of the frame and that have an open position and a normally biased closed position; and a cam supported by the frame and operated from the grip end of the handle. The cam is constructed and arranged to control the position of the blades so that in one position thereof the blades are partially opened allowing the blades to pivot, and in another position thereof the blades are nested against the frame so that the blades are maintained in the closed position.

22 Claims, 16 Drawing Sheets

DEVICE FOR PROPELLING A VESSEL

FIELD OF THE INVENTION

The present invention relates in general to a device for propelling a vessel and pertains, more particularly, to a paddle, oar or the like device used to propel a boat or a canoe. The present invention relates even more particularly to a device that is arranged so that it can be used as a normal paddle or can be reconfigured for use without being withdrawn from the water.

BACKGROUND OF THE INVENTION

In the use of a conventional paddle such as used with a boat or canoe, in use, the paddle has to either be withdrawn from the water at the end of each stroke or has to be manually turned at the end of a stroke.

It is an object of the present invention to provide an improved device for propelling a vessel employing foldable blades and in which the paddle can be maintained in the water during both the initial stroke of the paddle and a return stroke.

Another object of the present invention is to provide an improved paddle construction that can be formed for operating as either a normal paddle configuration or one in which the blades are automatically deployed upon the beginning of each propelling stroke.

SUMMARY OF THE INVENTION

To accomplish the foregoing and other objects, features and advantages of the present invention there is provided a device for propelling a vessel through water, that comprises an elongated handle; a grip at one end of the elongated handle; a paddle-shaped frame at an opposite end of the handle; a pair of blades that are pivotally supported at opposed respective sides of the frame and that have an open position and a normally biased closed position; and a cam supported by the frame and operated from the grip end of the handle. The cam is constructed and arranged to control the position of the blades so that in one position thereof the blades are partially opened allowing the blades to pivot, and in another position thereof the blades are nested against the frame so that the blades are maintained in the closed position.

In accordance with another aspects of the present invention including a cam shaft that extends from the grip to the cam, and wherein the grip is rotated to, in turn, rotate the cam shaft and cam in order to move the cam between the one and another positions; including a spring mechanism supported in the frame and coupled to each of the blades; wherein the cam is positioned at the frame at a location so that, in the one position, the blades are maintained partially spaced from the frame to enable the force of the water against an inner surface of the blades in order to deploy the blades outwardly; wherein the cam has a lobe that, in the one position, contacts and limits the closed position of the blades so that there is a space between a free end of the blades and the frame to enable the force of the water against an inner surface of the blades in order to deploy the blades outwardly; wherein the cam also has a non-lobe surface so that, in the another position of the cam, the blades are fully closed against the frame; including a spring mechanism comprising a pair of springs fixed in position within the frame and a pair of linkage mechanisms, each link mechanism including two linkages coupled between the spring mechanism and a blade; and wherein the two linkages are arranged in a crisscross pattern having one connected to one blade and the other connected to the other blade of the pair of blades.

In accordance with another version of the present invention there is provided a paddle device for propelling a vessel through water, and including a handle that is for grasping by a user; and a framework at a distal end of the handle. The framework has opposed respective sides and also having opposed respective edges. A pair of blades are pivotally supported at opposed respective sides of the frame, each having inner and outer surfaces, and that are constructed and arranged for a pivoting motion between an extended position in which, from the force of the water against the inner surface of the blades, the blades are deployed outwardly to an inline relationship so as to propel the vessel, and a withdrawn position in which, from the force of the water against the outer surface of the blades, the blades fold inward to a position nested toward the framework, and a stop is supported by the framework and constructed and arranged to maintain the blades partially spaced from the framework to enable the force of the water against the inner surface of the blades in order to deploy the blades outwardly.

In accordance with other aspects of the present invention the stop comprises a cam, the handle has an elongated handle shaft and further including a grip at a proximal end of the elongated handle shaft and a cam shaft controlled from said grip to rotate said cam to a first position which contacts and limits the closed position of the blades so that there is a space between a free end of the blades and the frame to enable the force of the water against an inner surface of the blades in order to deploy the blades outwardly; the cam is also controlled to a second position so that the blades are fully closed against the framework; wherein, in the second position, there is no space between a free end of the blades and the framework; including a spring mechanism supported in the frame and coupled to each of the blades; wherein the spring mechanism comprising a pair of springs fixed in position within the frame and a pair of linkage mechanisms, each link mechanism including two linkages coupled between the spring mechanism and a blade; wherein the two linkages are arranged in a crisscross pattern having one connected to one blade and the other connected to the other blade of the pair of blades; and wherein the cam has a lobe that, in the one position, contacts and limits the closed position of the blades so that there is a space between a free end of the blades and the frame to enable the force of the water against an inner surface of the blades in order to deploy the blades outwardly, and the cam also has a non-lobe surface so that, in the another position of the cam, the blades are fully closed against the frame.

In accordance with still another version of the present invention there is provided a paddle device for propelling a vessel through water, comprising: an elongated handle that is for grasping by a user; a framework at a distal end of the handle; said framework having opposed respective sides and also having opposed respective leading and trailing edges; a pair of blades that are pivotally supported at opposed respective sides of the frame, each having inner and outer surfaces, and that are constructed and arranged for a pivoting motion in which, from the force of the water against the inner surface of the blades, the blades are deployed outwardly to an inline relationship so as to propel the vessel; and a stop supported by the framework and constructed and arranged to maintain the blades partially spaced from the framework to enable the force of the water against the inner surface of the blades in order to deploy the blades outwardly.

In accordance with further aspects of the present invention the stop comprises a cam, the handle has an elongated handle shaft and further including a grip at a proximal end of the elongated handle shaft and a cam shaft controlled from said grip to rotate said cam to a first position which contacts and limits the closed position of the blades so that there is a space between a free end of the blades and the frame to enable the force of the water against an inner surface of the blades in order to deploy the blades outwardly; the cam is also controlled to a second position so that the blades are fully closed against the framework, and wherein, in the second position, there is no space between a free end of the blades and the framework; and a spring mechanism is supported in the frame and coupled to each of the blades, and wherein the spring mechanism comprising a pair of springs fixed in position within the frame and a pair of linkage mechanisms, each link mechanism including two linkages coupled between the spring mechanism and a blade.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 15:
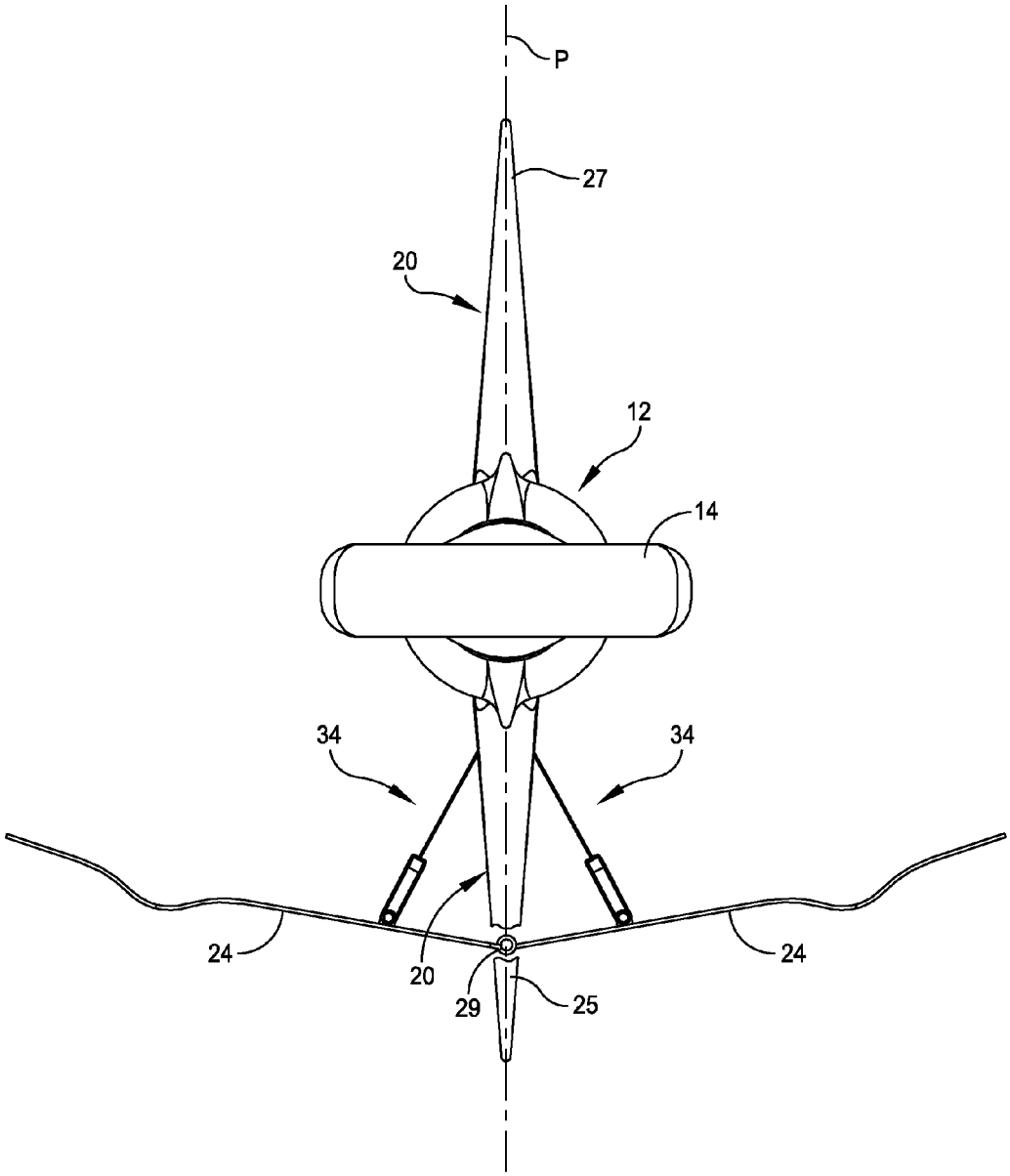
FIG. 15 is a schematic plan view illustrating the two blades having been moved to an open or deployed position.
Figure 19:
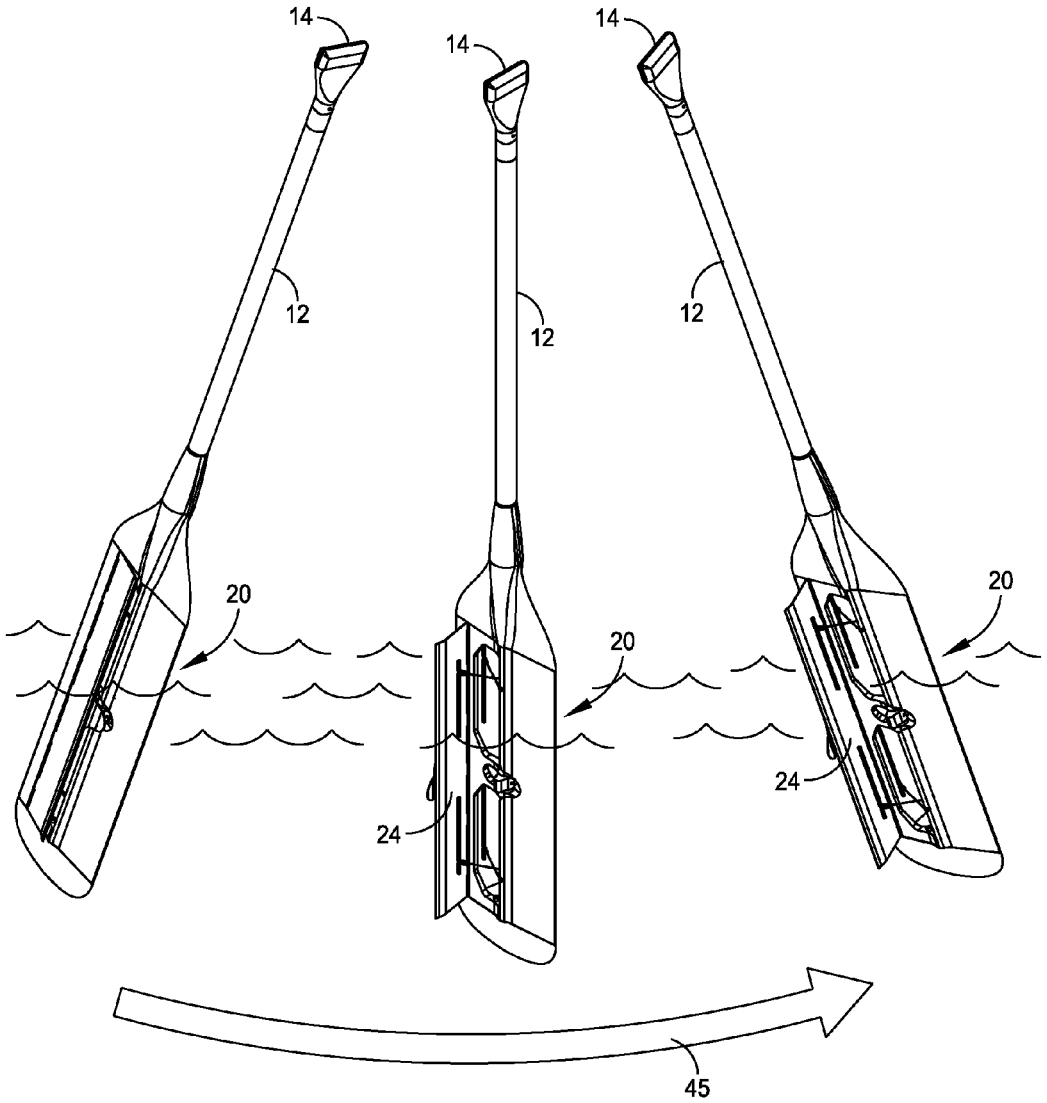
FIG. 19 is an illustration of an initial stroke of the device with the blades opening to facilitate the propelling.
Figure 20:
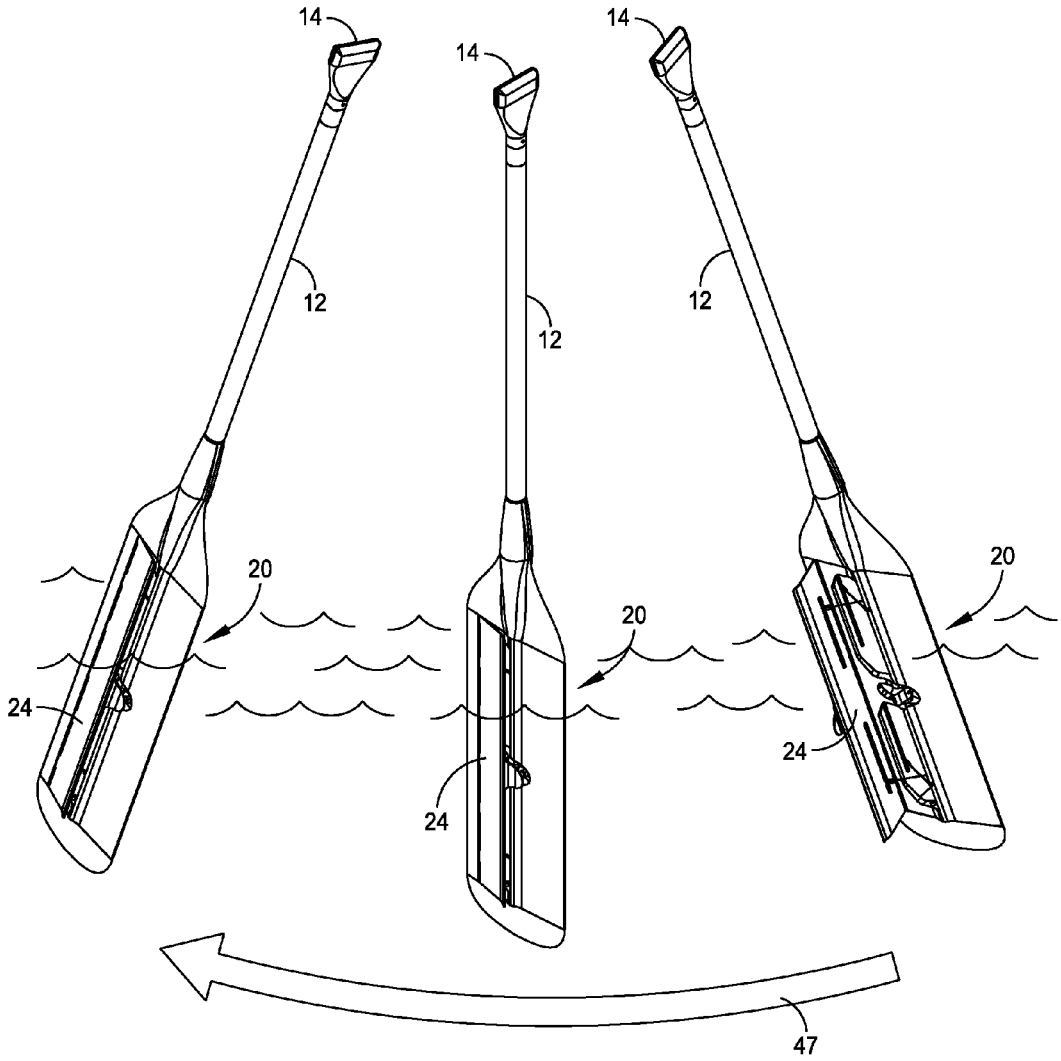
FIG. 20 is an illustration similar to that shown in FIG. 19 but with the stroke being made in the opposite direction closing both blades.

Reference is now made to the drawings for an illustration of the principles of operation of the device of the present invention. This device is illustrated primarily in the form of a paddle that can be used in propelling a canoe. However, the principles of the present invention can be applied in a variety of applications for propelling a vessel. The device of the present invention is meant to be operated so that when the paddle is moved in a first direction such as illustrated in FIG. 19, both blades 24 open; only one blade is illustrated in FIG. 19. See also FIGS. 15 and 18 for an illustration of the two blades 24 extending to an open position in which they extend essentially orthogonal to the plane P of the paddle framework. The paddle is intended to be moved in the direction of the leading and trailing edges 22, 25. The return stroke is illustrated in FIG. 20 wherein the blades 24 are moved in a direction so than an outer surface thereof has the water directed thereat causing the blades to fold inwardly, such as toward a position shown in FIG. 17. The net result is that in one stroke the blades are moved outwardly for propelling the vessel and in a return stroke the blades are moved inwardly so as to not interfere with the motion of the basic skeletal framework as it passes back through the water. In that way the paddle can stay in the water during the return stroke with minimum resistance because the direction is that along the plane P.

Figure 16:
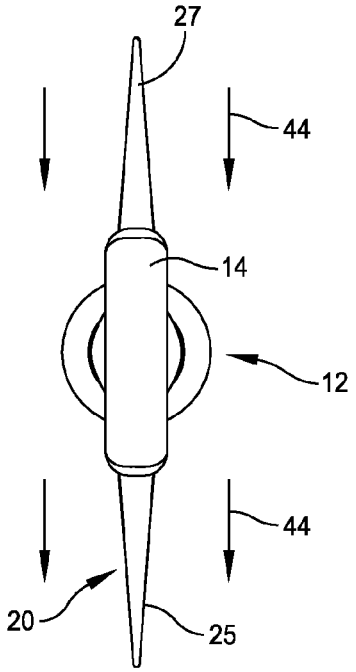
FIG. 16 is a schematic illustration showing water flow about the framework when the blades are fully closed.
Figure 17:
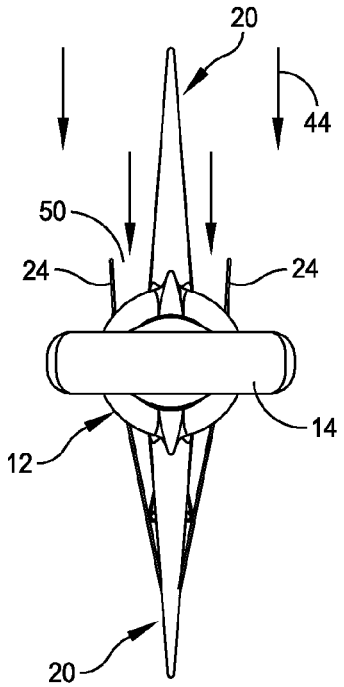
FIG. 17 is a schematic illustration showing the water flow causing the blades to be partially opened.
Figure 18:
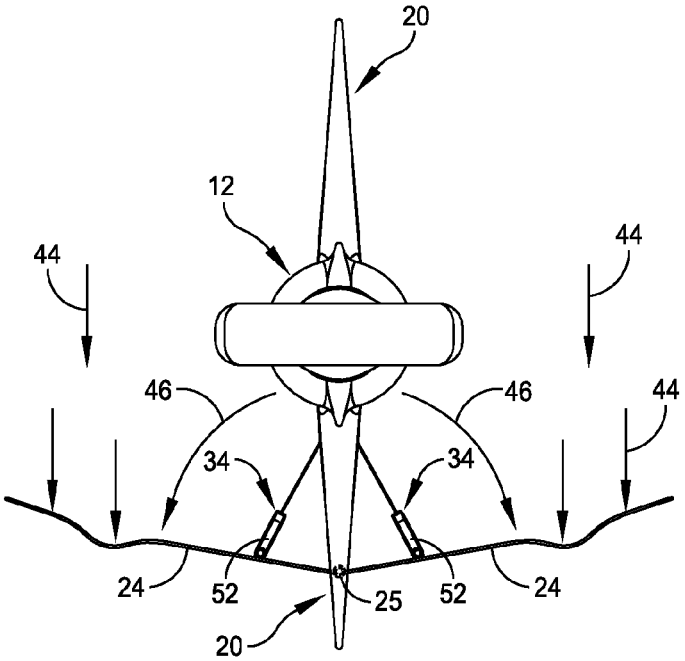
FIG. 18 is a schematic plan view illustrating the two blades opened to a fully deployed position.

Reference may also be made to the illustrations of FIGS. 16-18. In FIG. 16, one can consider that to be the basic configuration of the paddle framework in which there is minimum resistance as the framework is returned in the backstroke. On the other hand, FIG. 18 illustrates the force imposed by the water as arrows 44 against the blades 24 in order to provide a propelling of the vessel. FIG. 17 shows an intermediate position with the blades 24 about to be opened at the beginning of a first forward stroke.

Figure 2:
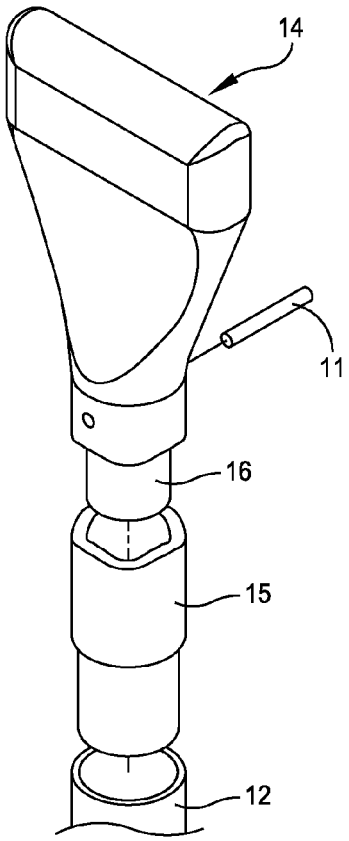
FIG. 2 is an illustration of the grip end of the device with the grip being in a first position.
Figure 3:
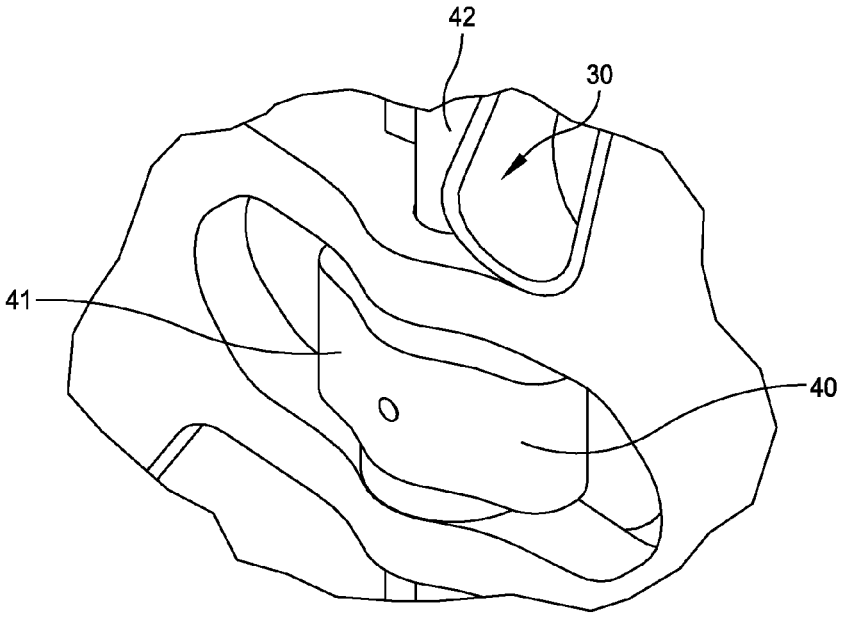
FIG. 3 is a fragmentary perspective view of the cam used with the device.
Figure 4:
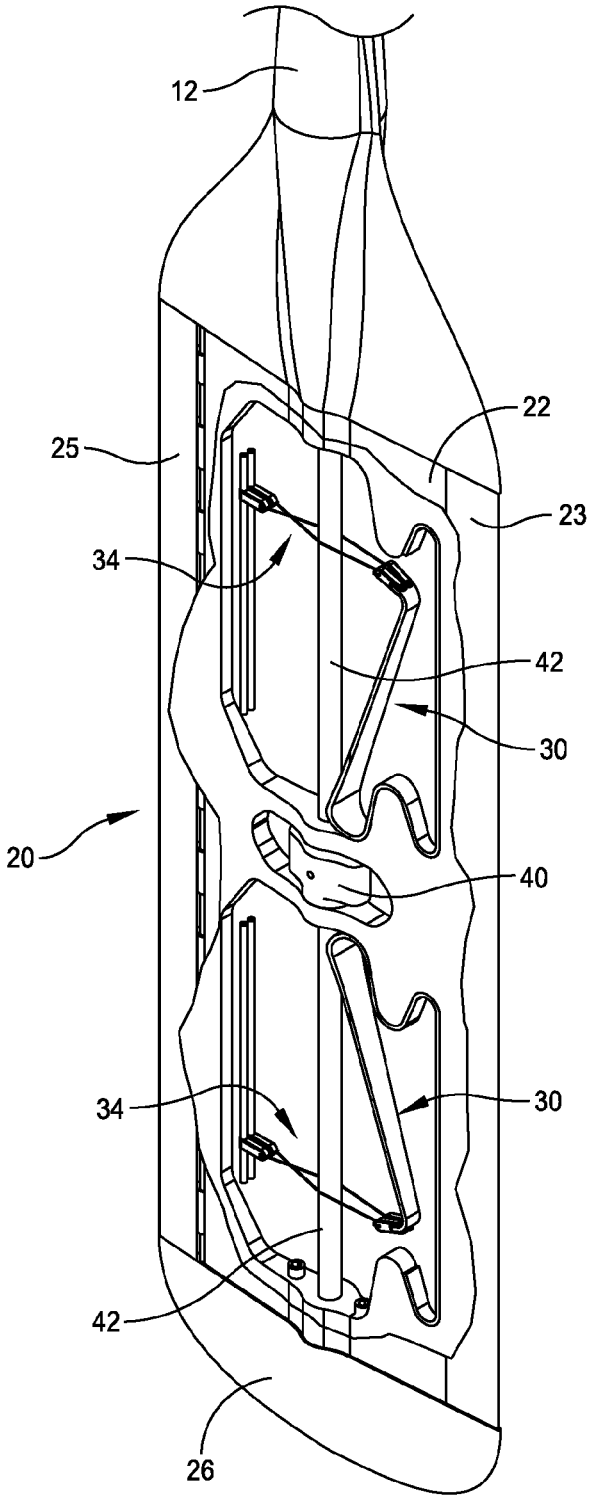
FIG. 4 is an enlarged perspective view of the device with portions cut away to illustrate the internal mechanism including a spring and linkage mechanism.
Figure 5:
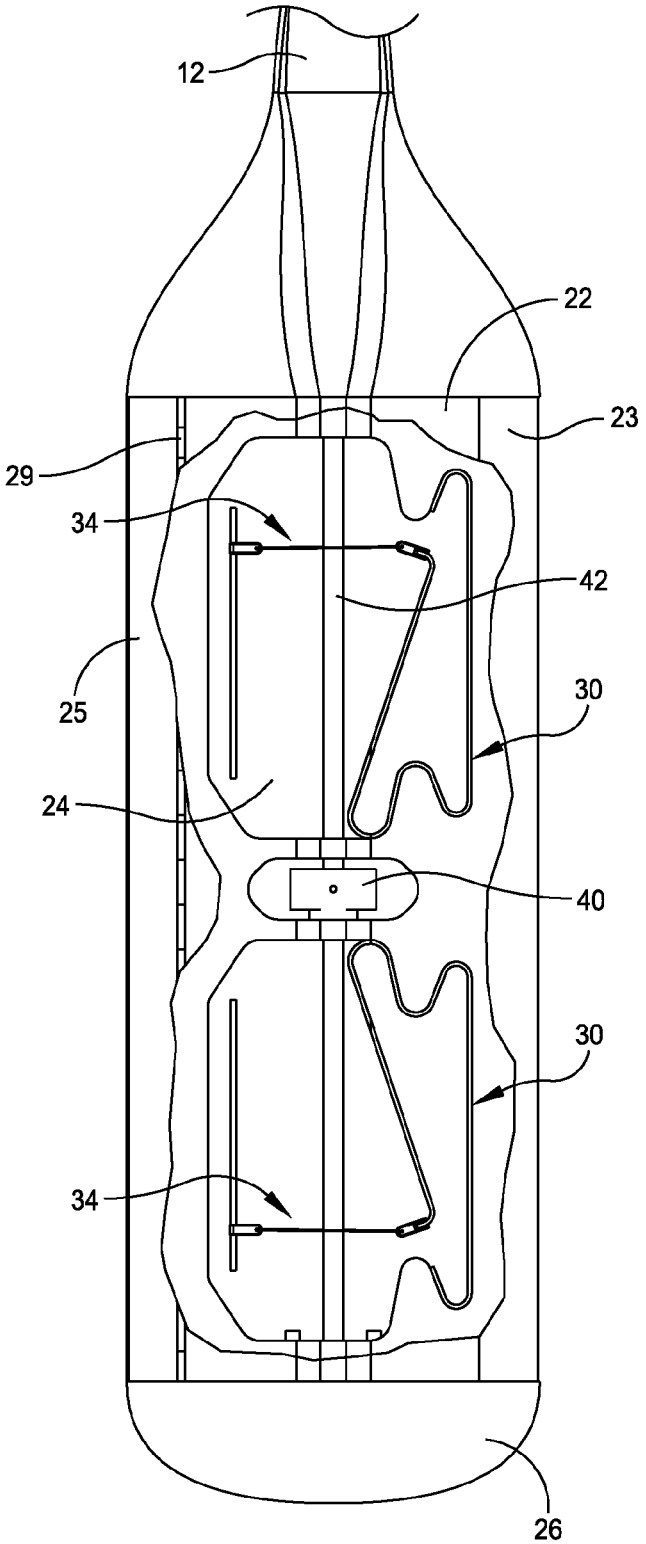
FIG. 5 is a frontal view of the device illustrated in FIGS. 1-4.
Figure 21:
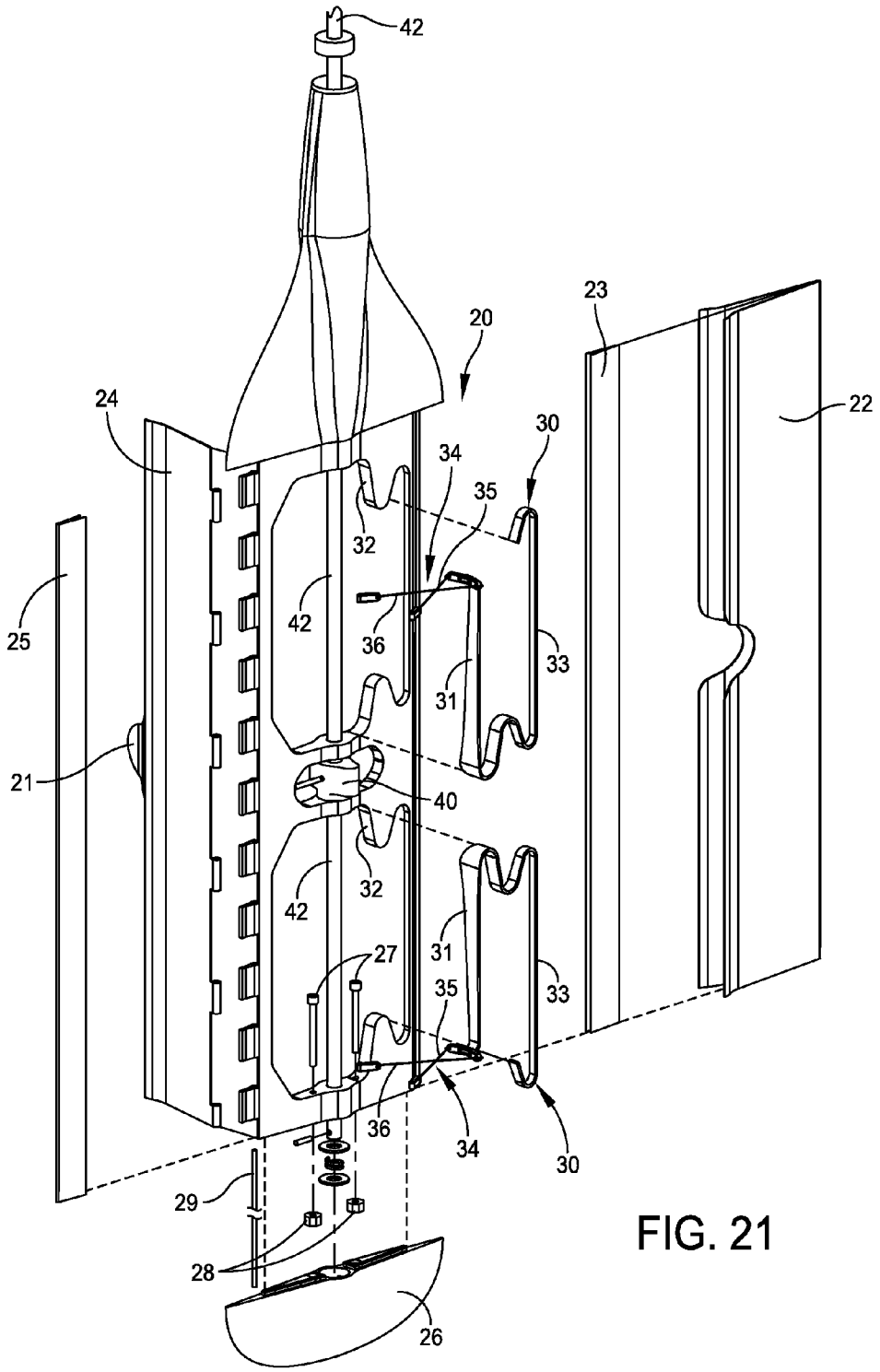
FIG. 21 is an exploded perspective view of the components comprising the device of the present invention.

The device 10 is basically comprised of a handle shaft 12, at a proximal end thereof, a grip 14, and at a distal end thereof, the paddle framework 20. The grip 14 is rotatable between positions initially as shown in FIG. 2, through a 45 degree angle to the position shown in FIG. 7 and to a fully 90 degree position illustrated in FIG. 10. In this regard, it is noted in FIG. 3 that the cam 40, which is attached to the grip by means of the camshaft 42, thus assumes different corresponding positions. In FIG. 3 the cam 40 is nested within the framework; in FIG. 8 the cam 40 is shown partially rotated outwardly; and in FIG. 11 the cam 40 is shown with its lobe 41 fully extending to a position orthogonal to the general plane P of the paddle framework. In this regard, and with regard to the grip 14, FIG. 2 also shows an adaptor 15 and a pivot member 16. Refer also, for example, to FIG. 4 that illustrates the camshaft 42 coupling with the cam 40. Refer also to the component diagram of FIG. 21 showing the camshaft 42 that extends from the grip down to the cam 40 and beyond for full support thereof within the framework.

These different positions of the cam 40 are discussed in further detail hereinafter with regard to the different modes of operation of the device.

Figure 1:
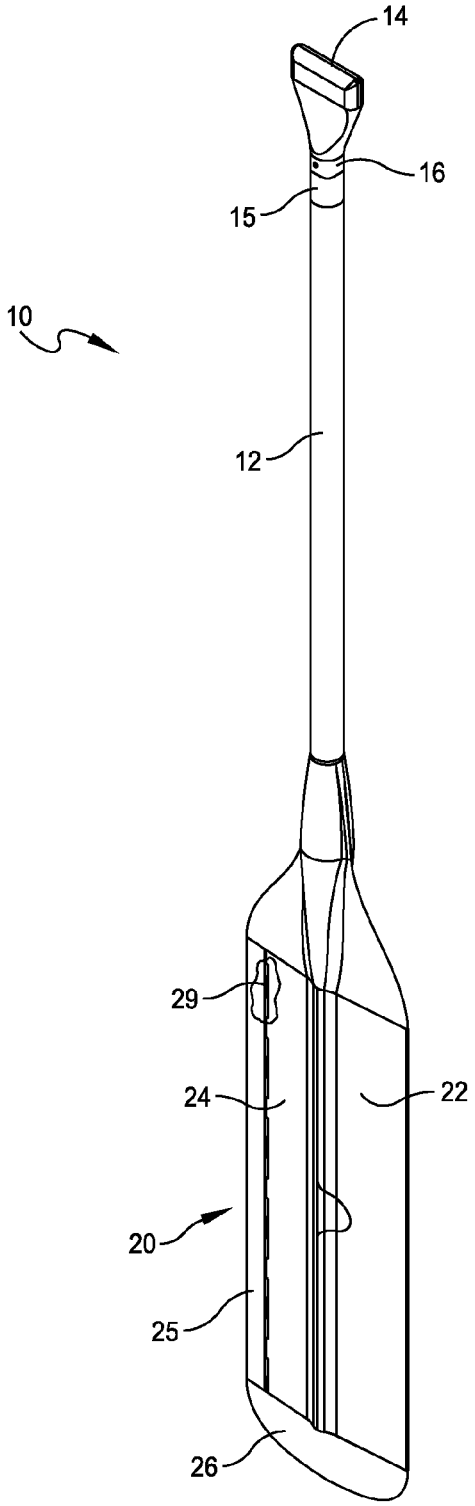
FIG. 1 is a perspective view of the device of the present invention.

The two blades 24 are normally urged toward a nested position and when the grip is in the position illustrated in FIGS. 1 and 2, wherein the cam 40 is not extending outwardly at all, then the two blades 24 rest in direct contact with the framework. This provides a contour much like that illustrated in FIG. 16 in which the framework structure has leading and trailing edges but does not have any gap for enabling an opening of either of the blades, upon initiation of a stroke. Thus, in that position, the paddle of the present invention, such as illustrated in FIGS. 1-5 functions much like a normal canoe paddle.

Figure 6:
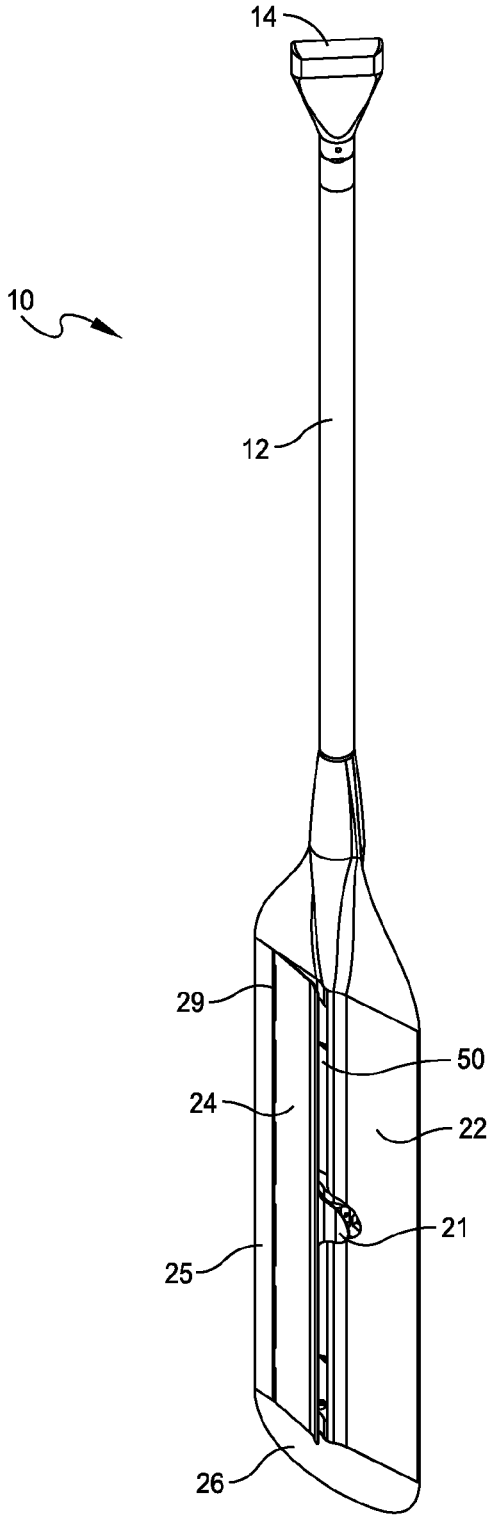
FIG. 6 is a perspective view like that illustrated in FIG. 1 but with the handle grip rotated 45 degrees so that both of the blades are slightly rotated outwardly.
Figure 7:
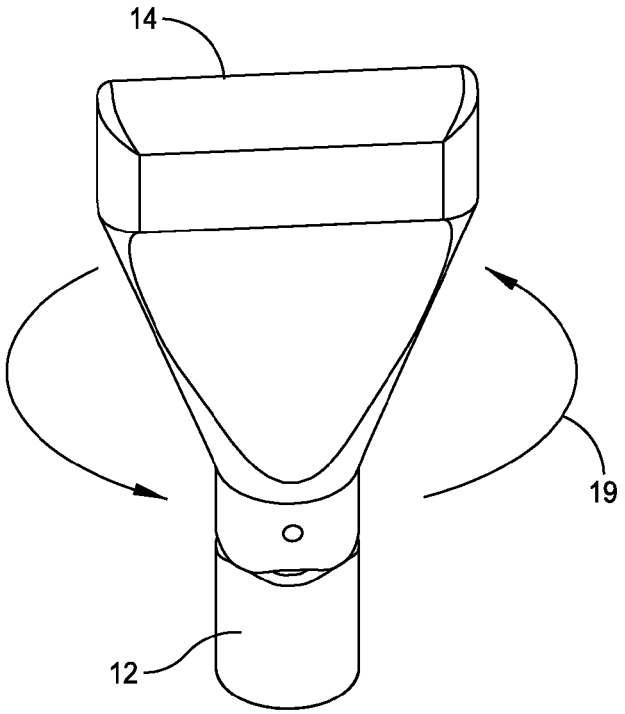
FIG. 7 is a perspective illustration at the grip with the grip turned 45 degrees.
Figure 8:
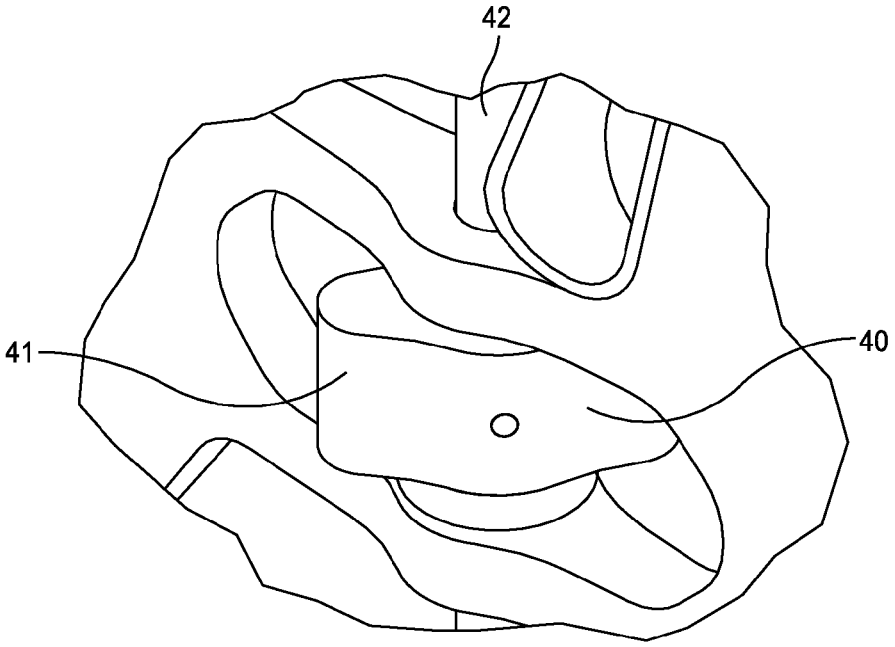
FIG. 8 is a fragmentary perspective view like that illustrated in FIG. 3 and showing the corresponding rotation of the cam through 45 degrees.
Figure 9:
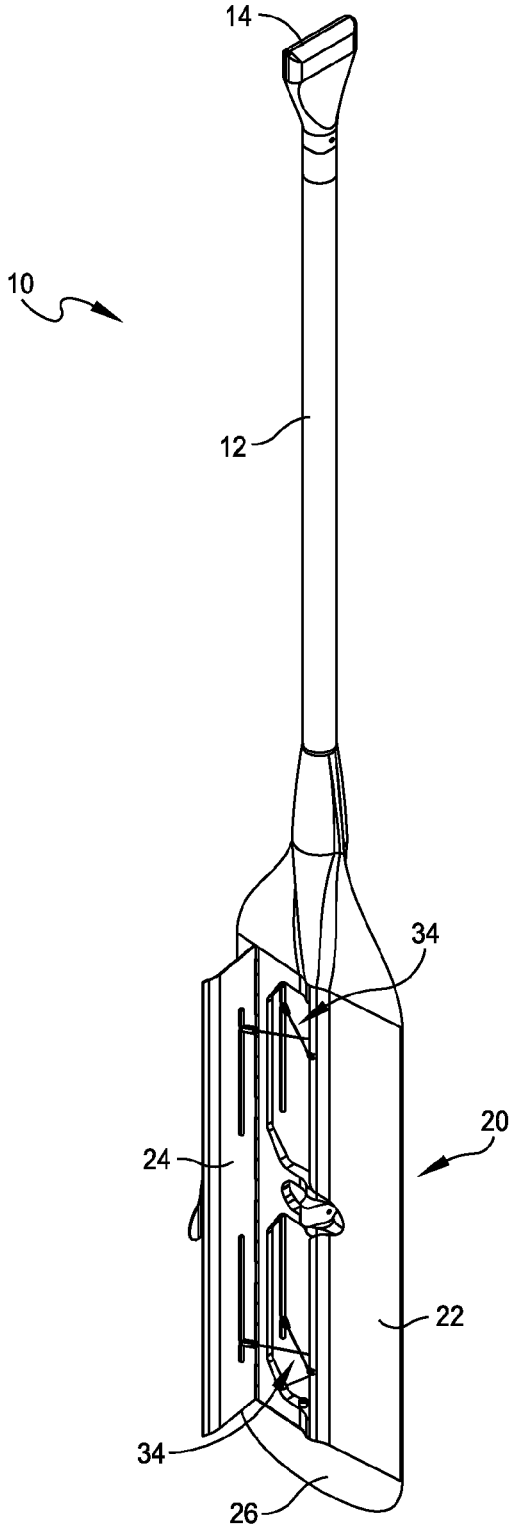
FIG. 9 is a perspective view like that illustrated in FIGS. 1 and 6 with the grip rotated through a full 90 degree angle.
Figure 10:
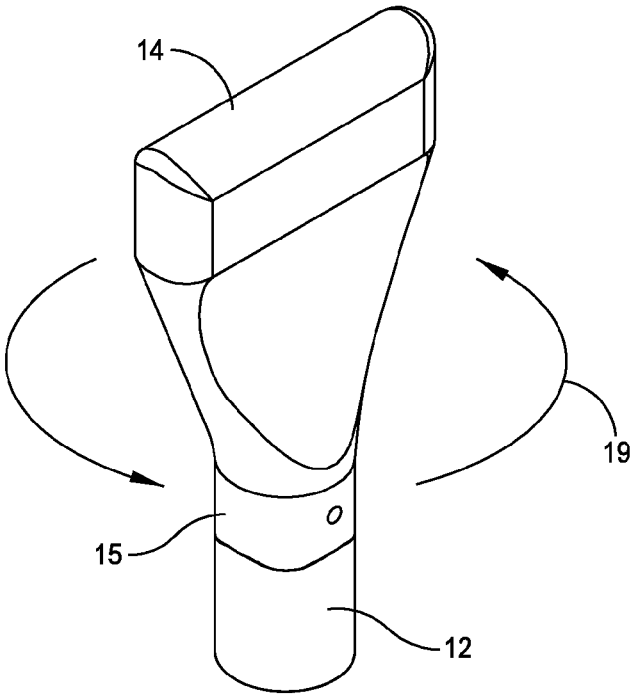
FIG. 10 is an illustration of the grip having been rotated through the full 90 degrees.
Figure 11:
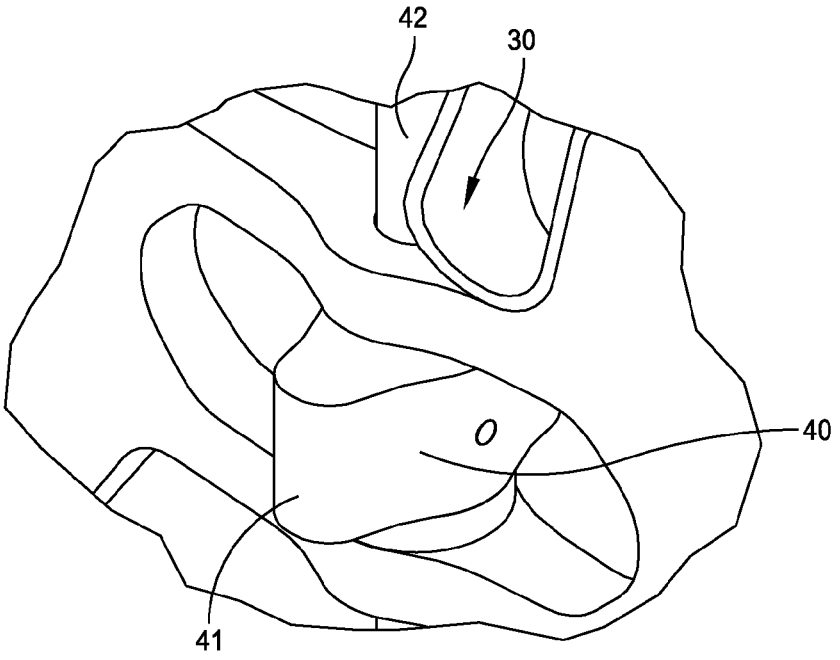
FIG. 11 is a fragmentary perspective view illustrating the positioning of the cam having now been rotated through 90 degrees.

Reference is now made to FIGS. 7 and 8 to simply illustrate that the grip 14 can be rotated either to a 45 degree position but would normally be rotated from the position shown in FIG. 2 to a position such as illustrated in FIG. 10 wherein the cam 40 is positioned with its lobe 41 extending outwardly as illustrated in FIG. 11. This position is also illustrated in the cutaway view of FIG. 12. Refer also to the perspective view of FIG. 6 wherein one of the blades 24 is shown partially opened at a gap 50 by means of an extension 21 of blade 24 engaging against the lobe 41 of the cam 40. In other words, in that particular position the blades 24 are not allowed to be fully nested against the framework and instead are positioned so that there is a small gap 50 as illustrated in FIG. 6, as well as in FIG. 17. This gap 50 is important in providing a space so that as the paddle is moved through the water, such as illustrated in FIG. 17, the water, illustrated by arrows 44, causes the blades to open. FIG. 17 shows the initial opening of the blades 24 while FIG. 18 shows the full deployment position of the blades 24. In a view such as FIG. 12 only one of the blades 24 is shown on one side of the framework while a further blade is shown pivoted outwardly as viewed from through the framework. The two blades are clearly illustrated in FIGS. 15 and 18 fully deployed.

Figure 12:
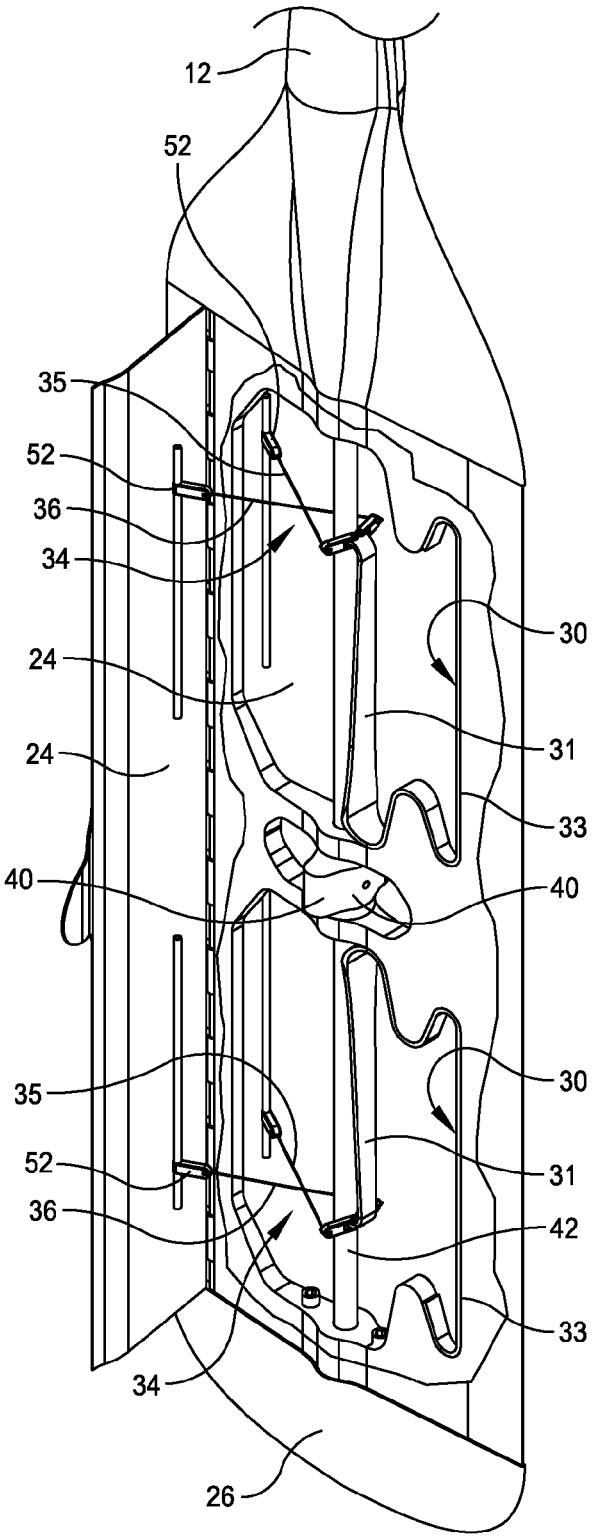
FIG. 12 is a perspective view at the frame end of the device illustrating the opening of one of the two propelling or movable blades 24.
Figure 13:
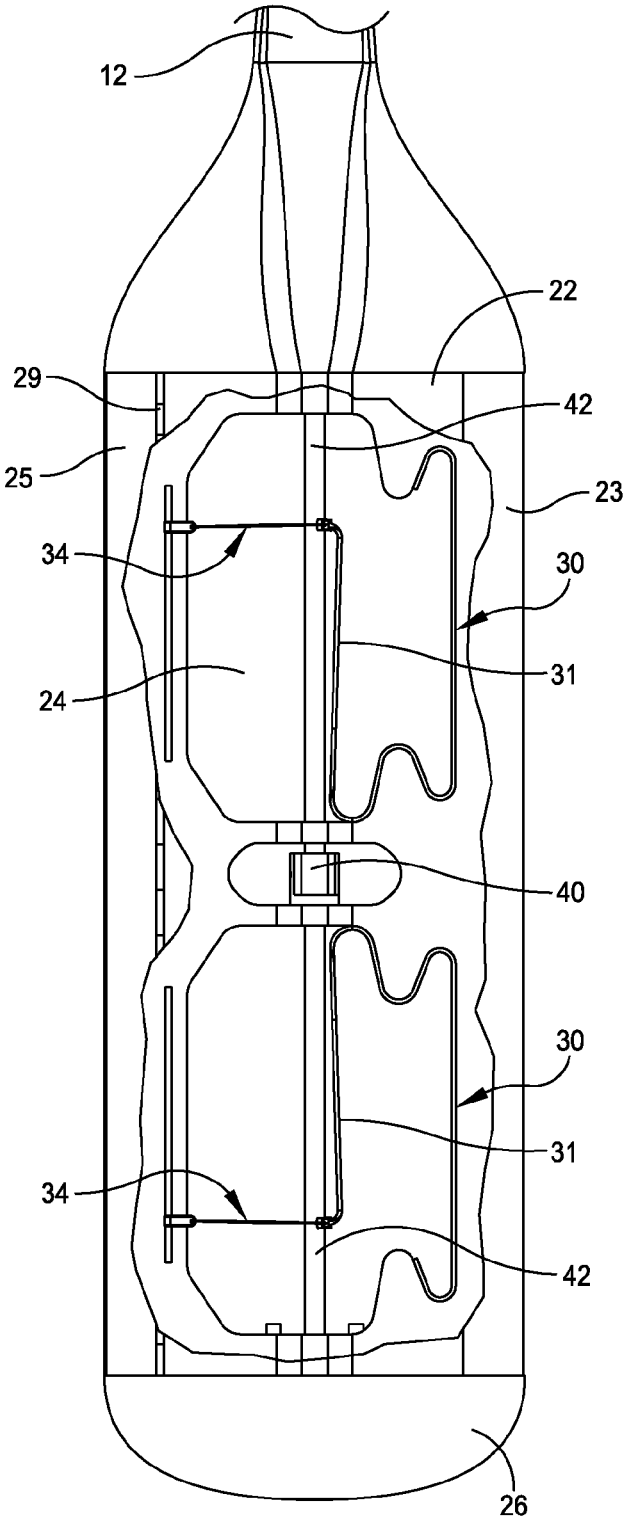
FIG. 13 is a frontal view with much of the construction cut away to illustrate the portion of the spring and linkage mechanisms.
Figure 14:
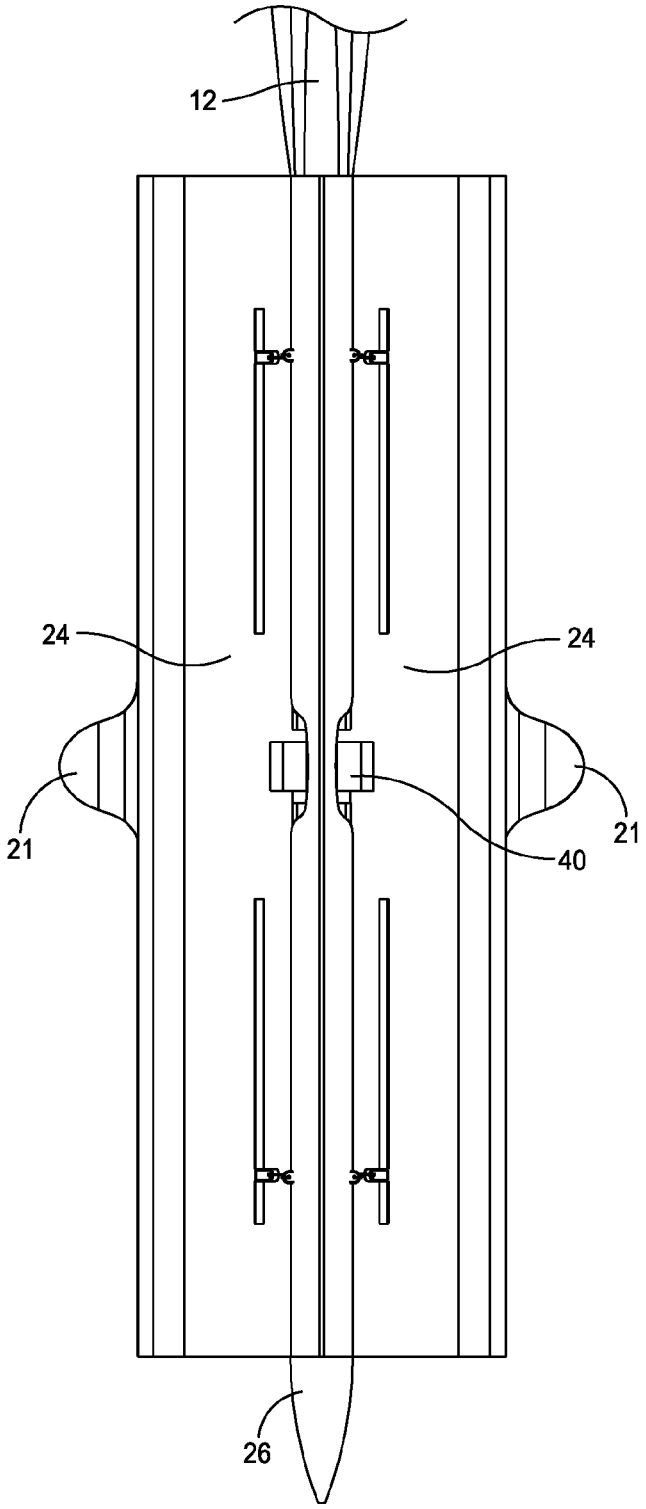
FIG. 14 is a left side view of the paddle framework.

Reference is now made to further details relating to the spring mechanisms and associated linkage mechanisms that are used for controlling the positioning of both of the blades 24. In this regard, reference may be made to, for example, FIGS. 4, 5, 12, 13 and 21. The spring mechanisms include a pair of springs 30 that are appropriately supported within a groove 32 in the framework. By way of example, FIG. 12 shows the two spring mechanisms 30 in position while FIG. 21 shows the spring mechanisms 30 exploded away from the framework. The spring mechanisms each include a fixed leg 33 and a movable leg 31. The linkage mechanisms attach to the free end of the movable leg 31.

The drawings also illustrate the linkage mechanisms 34 associated respectively with each spring mechanism 30. These linkage mechanisms include separate links 35 and 36. Reference to FIG. 12 clearly illustrates that the linkages 35 and 36 connect from a free end of the leg 31 of the spring to the respective blades 24 where they are firmly attached to each of the blades 24. This attachment is also shown, for example, at 52 in FIG. 18 wherein each linkage has a termination at the blade end. The linkages 35, 36 are also preferably arranged in a crisscross pattern as clearly shown in, for example, FIG. 12, wherein the linkages cross each other about the cam shaft 42. In this way the combination of the spring and linkage mechanisms provide a biasing force toward a closed position of both blades. The force of the water when the paddles is stroked overcomes this force to open each blade. The forces imposed on each blade by these mechanisms is preferably substantially equal so that the blades open at the same water counter force. Thus, the springs 30 function as stroke limiting devices when the blades are deployed outwardly such as to the position illustrated in FIG. 18.

At the very distal end of the framework there is also provided a blade tip 26. Refer, for example, to FIGS. 12 and 21. The tip 26 is attached at the bottom end of the framework by means of a pair of bolts 27 and associated nuts 28. FIGS. 18 and 21 also illustrate a hinge pin 29. There would be a hinge pin associated with each of the blades 24 functioning to allow a hinging of each of the blades 24. This is also schematically illustrated at 29 in FIG. 18. Either separate hinge pins or a common hinge pin to both blades may be employed. In the illustrated embodiment a common hinge pin is used for both blades.

Thus, when the grip is in the position as illustrated in FIGS. 10 and 11, there is a gap 50 provided between each of the blades and the framework. Again, this gap is shown at 50 in FIGS. 6 and 17. By providing a slight gap along the edge of each blade, as the blade is moved in a direction opposite to the arrows 44 in FIG. 17 the blades automatically deploy to the position shown in FIG. 18 against the bias of the spring mechanisms. This stroke direction is also illustrated by the arrow 45 in FIG. 19. FIG. 20 illustrates the paddle being then moved in the opposite direction but without being rotated. This causes an immediate closure of both of the blades 24 from the position shown toward the right in FIG. 20 to the center position. Thus, the device can be moved back and forth through the water without requiring it to be rotated and also without requiring it to be withdrawn from the water. An initial backward stroke, as shown in FIG. 19, causes the blades to open as water is forced against the blade surface and into the blade gap 50. In the action depicted in FIG. 20 the stroke is reversed and then moved in the opposite direction, and the blades close providing a relatively unimpeded path through the water. This action occurs without rotating the paddle and without the need for removing the paddle from the water. As also indicated previously, if the grip is in the position illustrated in FIGS. 1-5, then there is no gap 50 that is provided and the paddle can be used in the normal manner. The gap 50 can have a minimum gap dimension of say ½ inch, just enough to allow water flow into the skeleton framework. In the open position the framework is essentially open enabling the free flow of water through the framework, while at the same time causing the force of the water to pivot both blades to an open position such as illustrated in FIG. 18.

The blade edge 25 is assembled to the paddle frame preferably by means of a dove tail joint. With reference to FIG. 21, the part 23 may be glued into the part 22. The rear fixed blade assembly 22, 23 is also secured to the paddle frame by means of a dove tail joint.

In a further alternate embodiment of the present invention, rather than providing a grip that is rotated, the grip can be stationary and rather than providing a rotating cam, there is provided a stationary stop which would resemble the cam position shown in FIG. 11. In this way there would always be a slight gap between each of the blades in the supporting framework. Again, the use of the spacing gap 50 in this embodiment provides the action previously described herein.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A device for propelling a vessel through water, comprising:

an elongated handle;

a grip at one end of the elongated handle;

a paddle-shaped frame at an opposite end of the handle;

a pair of blades that are pivotally supported at opposed respective sides of the frame and that have an open position and a normally biased closed position;

and a cam supported by the frame and operated from the grip end of the handle;

said cam constructed and arranged to control the position of the blades so that in one position thereof the blades are partially opened allowing the blades to pivot, and in another position thereof the blades are nested against the frame so that the blades are maintained in the closed position.

2. The device of claim 1 including a cam shaft that extends from the grip to the cam, and wherein the grip is rotated to, in turn, rotate the cam shaft and cam in order to move the cam between the one and another positions.

3. The device of claim 1 including a spring mechanism supported in the frame and coupled to each of the blades.

4. The device of claim 1 wherein the cam is positioned at the frame at a location so that, in the one position, the blades are maintained partially spaced from the frame to enable the force of the water against an inner surface of the blades in order to deploy the blades outwardly.

5. The device of claim 4 wherein the cam has a lobe that, in the one position, contacts and limits the closed position of the blades so that there is a space between a free end of the blades and the frame to enable the force of the water against an inner surface of the blades in order to deploy the blades outwardly.

6. The device of claim 5 wherein the cam also has a non-lobe surface so that, in the another position of the cam, the blades are fully closed against the frame.

7. The device of claim 1 including a spring mechanism comprising a pair of springs fixed in position within the frame and a pair of linkage mechanisms, each link mechanism including two linkages coupled between the spring mechanism and a blade.

8. The device of claim 7 wherein the two linkages are arranged in a crisscross pattern having one connected to one blade and the other connected to the other blade of the pair of blades.

9. A paddle device for propelling a vessel through water, comprising:

a handle that is for grasping by a user;

a framework at a distal end of the handle;

said framework having opposed respective sides and also having opposed respective edges;

a pair of blades that are pivotally supported at opposed respective sides of the frame, each having inner and outer surfaces, and that are constructed and arranged for a pivoting motion between an extended position in which, from the force of the water against the inner surface of the blades, the blades are deployed outwardly to an inline relationship so as to propel the vessel, and a withdrawn position in which, from the force of the water against the outer surface of the blades, the blades fold inward to a position nested toward the framework;

and a stop supported by the framework and constructed and arranged to maintain the blades partially spaced from the framework to enable the force of the water against the inner surface of the blades in order to deploy the blades outwardly;

wherein said stop comprises a cam, the handle has an elongated handle shaft and further including a grip at a proximal end of the elongated handle shaft and a cam shaft controlled from said grip to rotate said cam to a first position which contacts and limits the closed position of the blades so that there is a space between a free end of the blades and the frame to enable the force of the water against an inner surface of the blades in order to deploy the blades outwardly.

10. The device of claim 9 wherein the cam is also controlled to a second position so that the blades are fully closed against the framework.

11. The device of claim 10 wherein, in the second position, there is no space between a free end of the blades and the framework.

12. The device of claim 11 including a spring mechanism supported in the frame and coupled to each of the blades.

13. The device of claim 12 wherein the spring mechanism comprising a pair of springs fixed in position within the frame and a pair of linkage mechanisms, each link mechanism including two linkages coupled between the spring mechanism and a blade.

14. The device of claim 13 wherein the two linkages are arranged in a crisscross pattern having one connected to one blade and the other connected to the other blade of the pair of blades.

15. The device of claim 14 wherein the cam has a lobe that, in the one position, contacts and limits the closed position of the blades so that there is a space between a free end of the blades and the frame to enable the force of the water against an inner surface of the blades in order to deploy the blades outwardly, and the cam also has a non-lobe surface so that, in the another position of the cam, the blades are fully closed against the frame.

16. A paddle device for propelling a vessel through water, comprising:

an elongated handle that is for grasping by a user;

a framework at a distal end of the handle;

said framework having opposed respective sides and also having opposed respective leading and trailing edges;

a pair of blades that are pivotally supported at opposed respective sides of the frame, each having inner and outer surfaces, and that are constructed and arranged for a pivoting motion in which, from the force of the water against the inner surface of the blades, the blades are deployed outwardly to an inline relationship so as to propel the vessel;

and a stop supported by the framework and constructed and arranged to maintain the blades partially spaced from the framework to enable the force of the water against the inner surface of the blades in order to deploy the blades outwardly wherein said stop comprises a cam, the handle has an elongated handle shaft and further including a grip at a proximal end of the elongated handle shaft and a cam shaft controlled from said grip to rotate said cam to a first position which contacts and limits the closed position of the blades so that there is a space between a free end of the blades and the frame to enable the force of the water against an inner surface of the blades in order to deploy the blades outwardly.

17. The device of claim 16 wherein the cam is also controlled to a second position so that the blades are fully closed against the framework, and wherein, in the second position, there is no space between a free end of the blades and the framework.

18. The device of claim 17 including a spring mechanism supported in the frame and coupled to each of the blades, and wherein the spring mechanism comprising a pair of springs fixed in position within the frame and a pair of linkage mechanisms, each link mechanism including two linkages coupled between the spring mechanism and a blade.

19. A paddle device for propelling a vessel through water, comprising:

a handle including an elongated handle shaft and a proximal grip that is for grasping by a user;

a framework at a distal end of the handle shaft;

said framework having opposed respective sides;

a pair of blades that are pivotally supported at opposed respective sides of the frame, each having inner and outer surfaces, and that are constructed and arranged for a pivoting motion between an extended position in which, from the force of the water against the inner surface of the blades, the blades are deployed outwardly so as to propel the vessel, and a withdrawn position in which, from the force of the water against the outer surface of the blades, the blades fold inward to a position nested toward the framework;

a cam disposed adjacent to said blades; and a cam shaft controlled to rotate said cam to a first position which contacts and limits the closed position of the blades so that there is a space between a free end of the blades and the frame to enable the force of the water against an inner surface of the blades in order to deploy the blades outwardly.

20. The device of claim 19 wherein the cam is also controlled to a second position so that the blades are fully closed against the framework, and wherein, in the second position, there is no space between a free end of the blades and the framework.

21. The device of claim 19 including a spring mechanism supported in the frame and coupled to each of the blades.

22. The device of claim 21 wherein the spring mechanism comprising a pair of springs fixed in position within the frame and a pair of linkage mechanisms, each link mechanism including two linkages coupled between the spring mechanism and a blade.

* * * * *